US006645035B1

(12) United States Patent
Tsai

(10) Patent No.: US 6,645,035 B1
(45) Date of Patent: Nov. 11, 2003

(54) MOVABLE MECHANICAL DOLL

(76) Inventor: Chih-Cheng Tsai, No. 13, Chung Hwa Rd., Lin Lo Village, Lin Lo Hsiang, Pingtung Hsien (TW)

( * ) Notice: Subject to any disclaimer, the term of this patent is extended or adjusted under 35 U.S.C. 154(b) by 0 days.

(21) Appl. No.: 10/430,870

(22) Filed: May 7, 2003

(51) Int. Cl.[7] ..... A63H 11/00
(52) U.S. Cl. ..... 446/330; 446/300; 446/354
(58) Field of Search ..... 446/330, 268, 446/297, 298, 300, 352, 353, 354, 383, 384, 390

(56) References Cited

U.S. PATENT DOCUMENTS 1,576,789 A * 3/1926 Robertson
3,964,205 A * 6/1976 Kuramochi ..... 46/120
4,875,886 A * 10/1989 Sung ..... 446/298
4,911,676 A * 3/1990 Fan ..... 446/300
5,695,382 A * 12/1997 Lin ..... 446/354
6,261,148 B1 * 7/2001 Robinson ..... 446/353
6,375,536 B1 * 4/2002 Yang ..... 446/353

* cited by examiner

*Primary Examiner*—Jacob K. Ackun
*Assistant Examiner*—Jamila Williams
(74) *Attorney, Agent, or Firm*—Jackson Walker L.L.P.

(57) ABSTRACT

A movable mechanical doll has a bottom seat and two legs upright formed on the bottom seat. A shoulder-arm part is mounted at tops of the legs, and has two arms respectively mounted at two sides of the shoulder-arm part. A housing covering the shoulder-arm part is pivotally mounted on the shoulder-arm part by a pivot pin. A driving assembly with a first motor is mounted in the housing to drive the housing to swing about the pivot pin. At the same time, the arms can be swung forwards and backwards. By this means, the movable mechanical doll can achieve an action of moving shoulders and arms.

6 Claims, 7 Drawing Sheets

MOVABLE MECHANICAL DOLL

BACKGROUND OF THE INVENTION

1. Field of the Invention

The present invention is related to a movable mechanical doll, and more particularly to a doll that has movable shoulders and arms driven by a mechanism and first motors.

2. Description of Related Art

Dolls have been a favorite toy for thousands of years. In conventional dolls, movable mechanical dolls are much more interesting than static dolls, because these movable mechanical dolls have movable body parts and can sing and speak.

A conventional movable mechanical doll which can move its shoulders and arms has such a complex structure that it is very convenient to assemble the doll and a manufacturing cost of the doll is high.

Therefore, the invention provides an improved movable mechanical doll to mitigate and/or obviate the aforementioned problems.

SUMMARY OF THE INVENTION

The main objective of the invention is to provide a movable mechanical doll which has a simple structure to achieve actions of moving its shoulders and arms.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
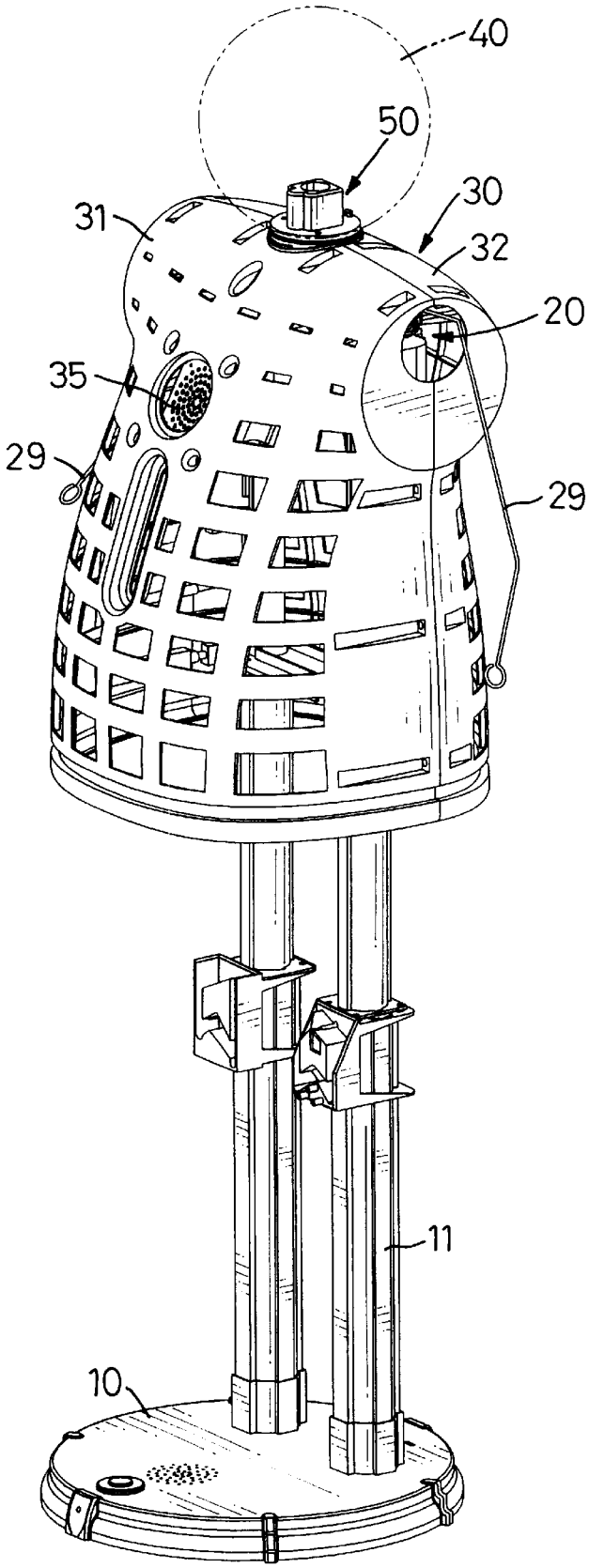
FIG. 1 is a perspective view of a movable mechanical doll in accordance with the invention.
Figure 2:
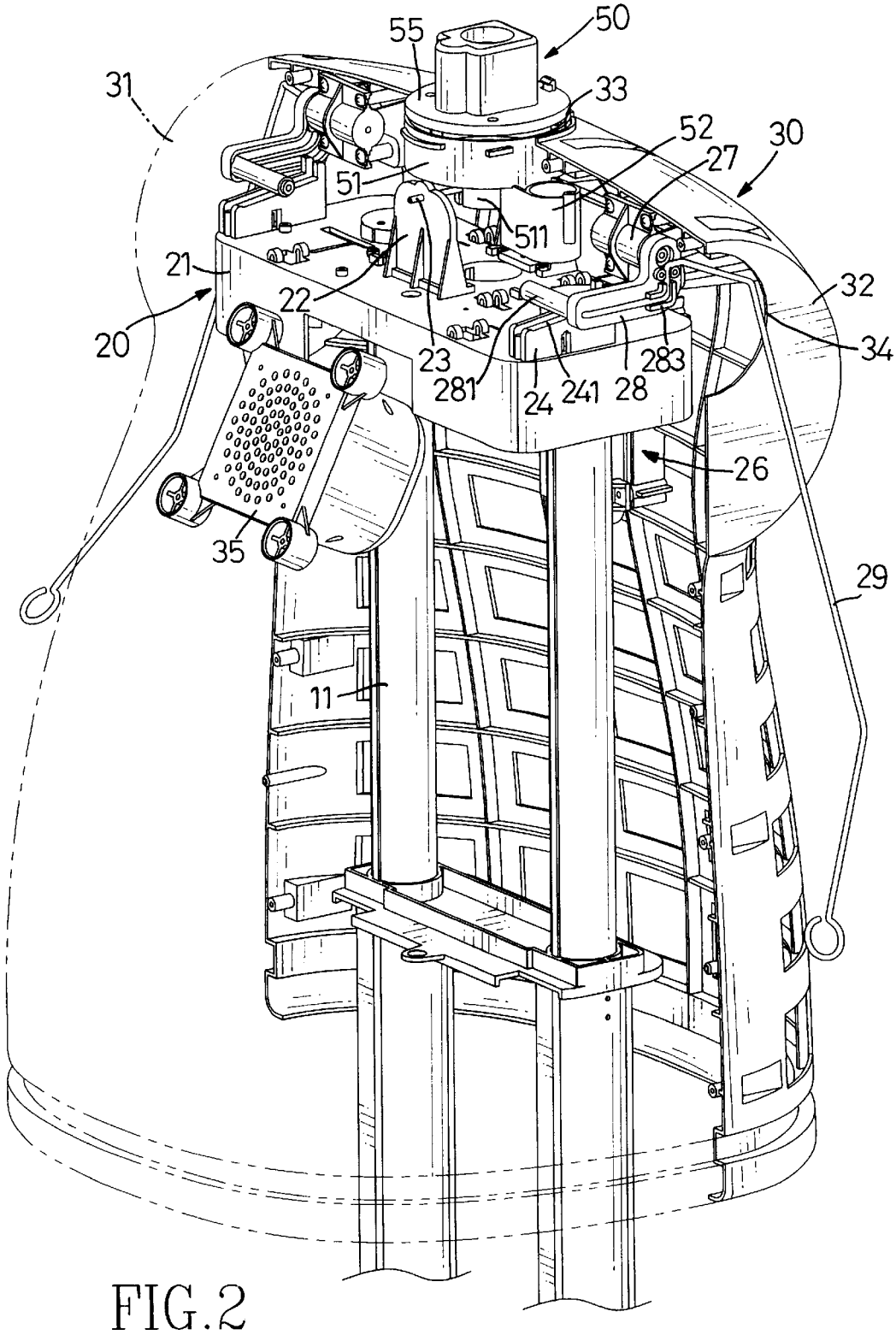
FIG. 2 is a partially front perspective view of the movable mechanical doll when a front semi-housing is removed.
Figure 3:
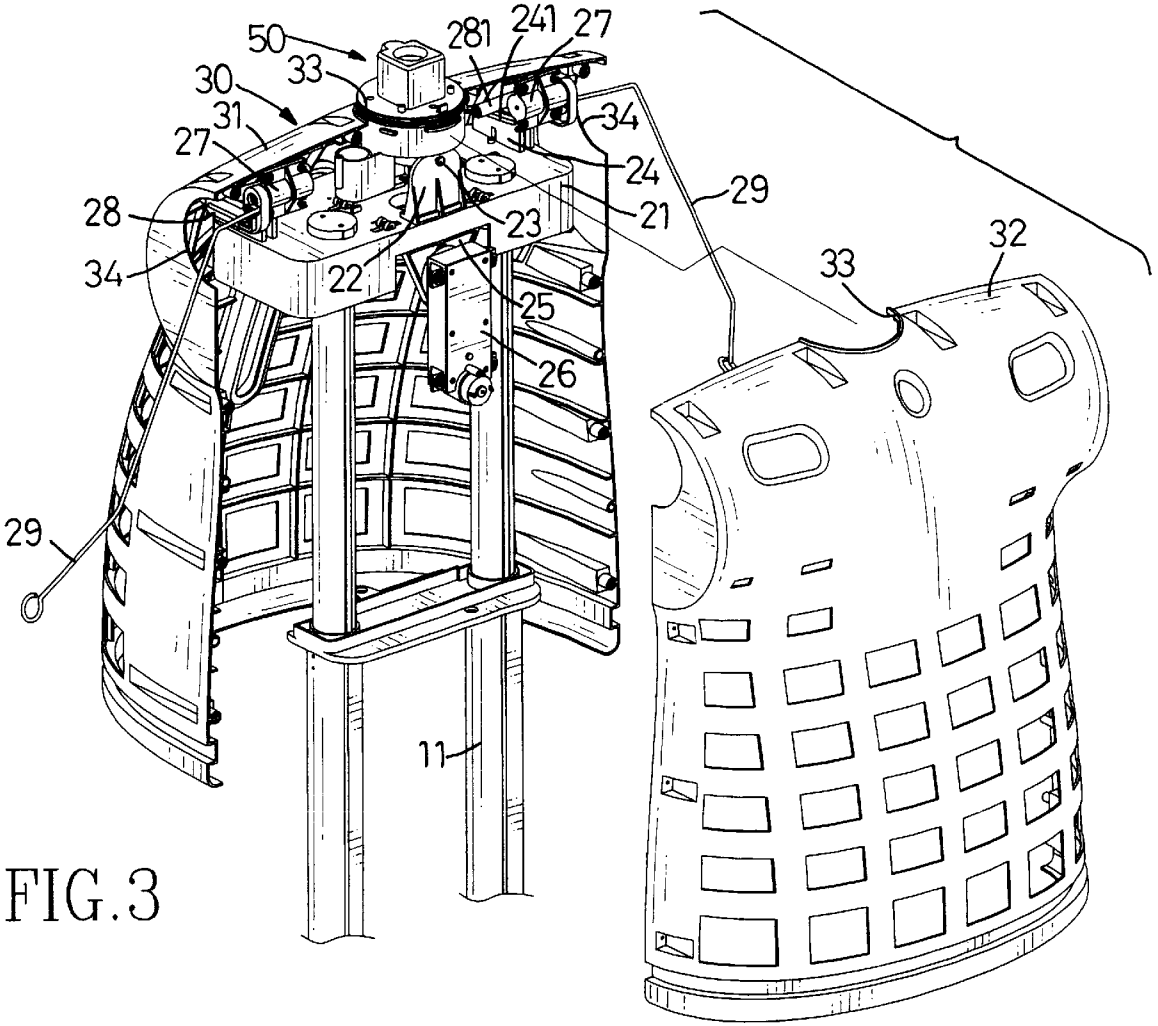
FIG. 3 is a partially rear perspective view of the movable mechanical doll when a rear semi-housing is removed.

Referring to FIGS. 1–3, a movable mechanical doll in accordance with the present invention has a bottom seat (10) in which a circuit board and a switch (not shown or numbered) are installed. Two legs (11) are upright formed on the bottom seat (10). A shoulder-arm part (20) is mounted at tops of the legs (11), and a housing (30) covering the shoulder-arm part (20). A head (40) is provide above the housing (30).

The housing (30) is composed of a front semi-housing (31) and a rear semi-housing (32), and has a neck opening (33) defined at a top thereof and two arm openings (34) respectively defined at two sides thereof. A neck part (50) extends from the neck opening (33), and two arms (29) respectively extends from the arm openings (34). A plurality of meshes (not numbered) is defined through the housing (30), so that the housing (30) has a low weight. A plurality of ribs (not numbered) is formed at inner walls of the housing (30) for reinforcing a strength of the housing (30).

Figure 4:
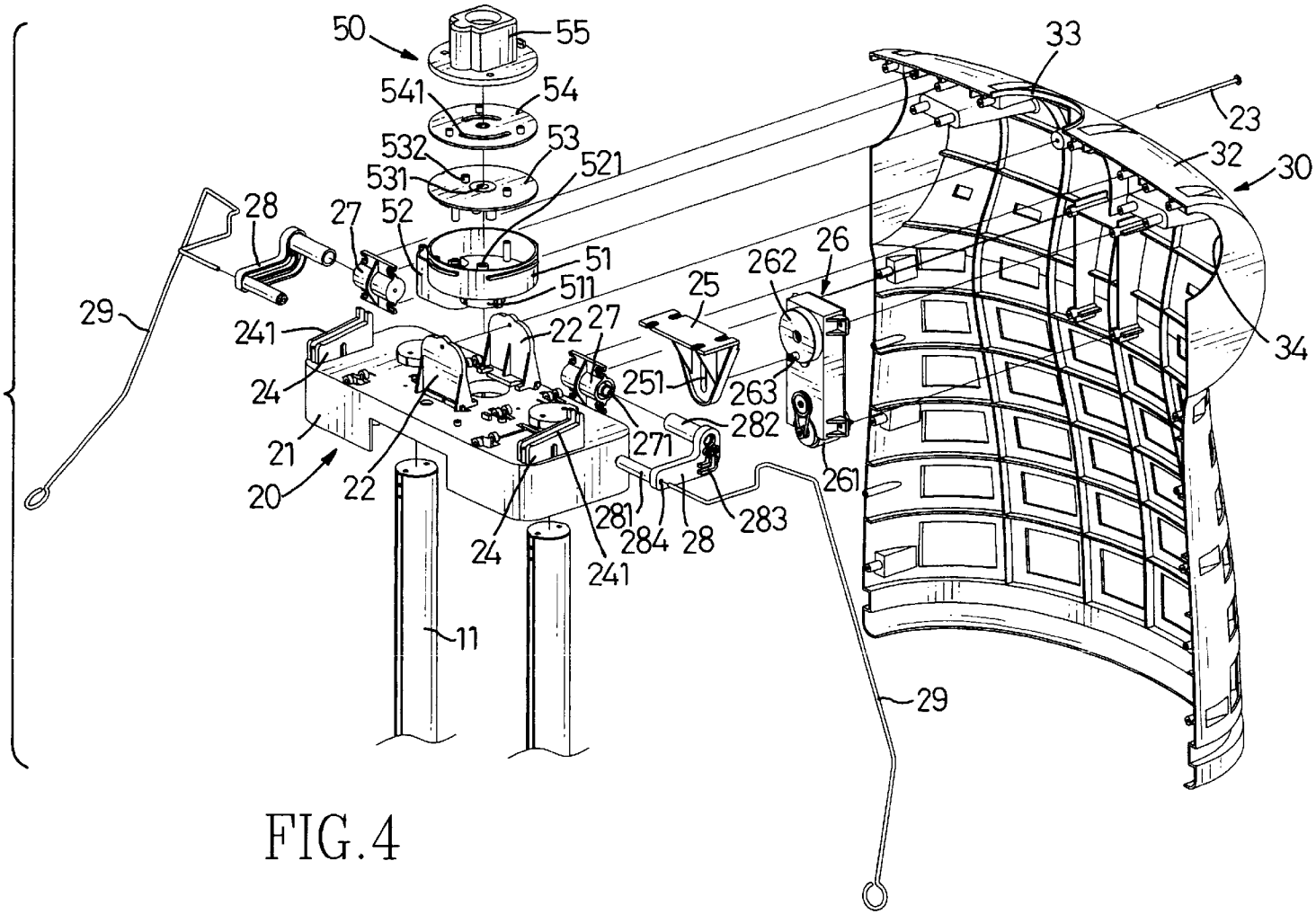
FIG. 4 is an exploded perspective view of a shoulder-arm part of the movable mechanical doll.
Figure 5:
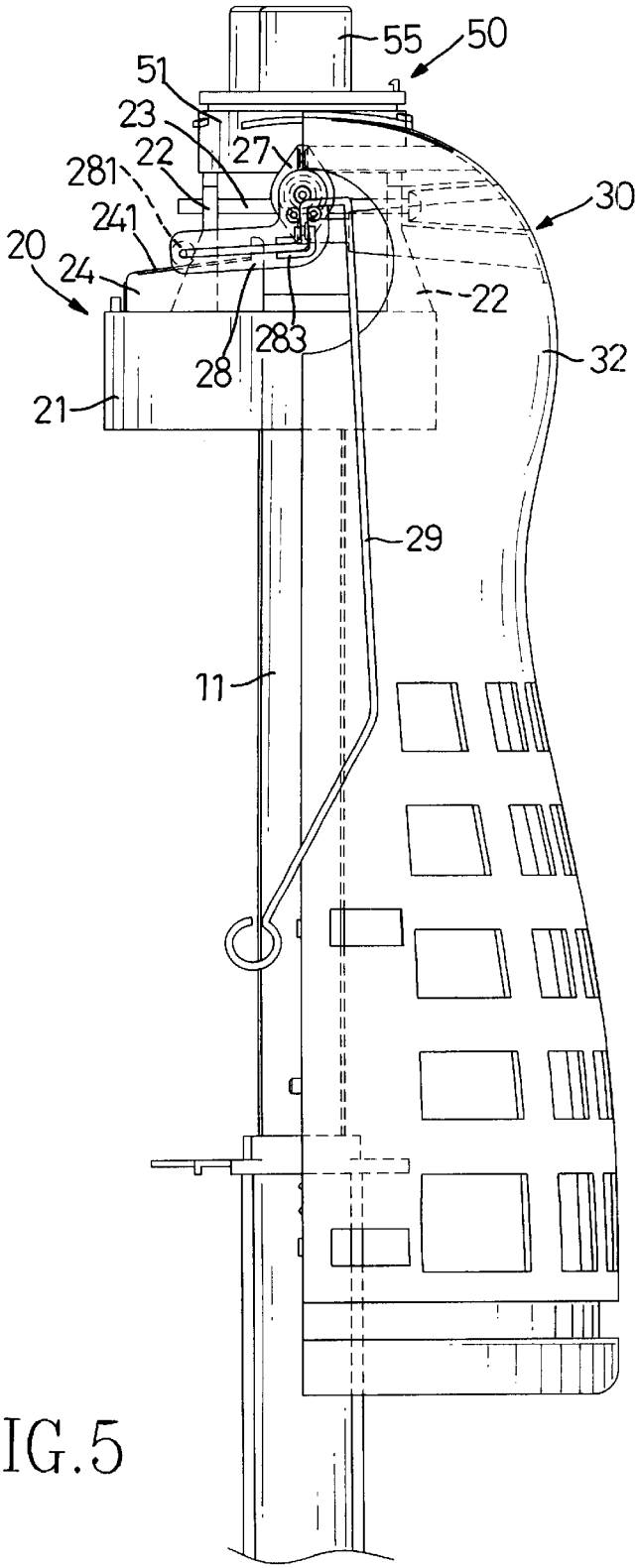
FIG. 5 is a partially side view of the movable mechanical doll.
Figure 6:
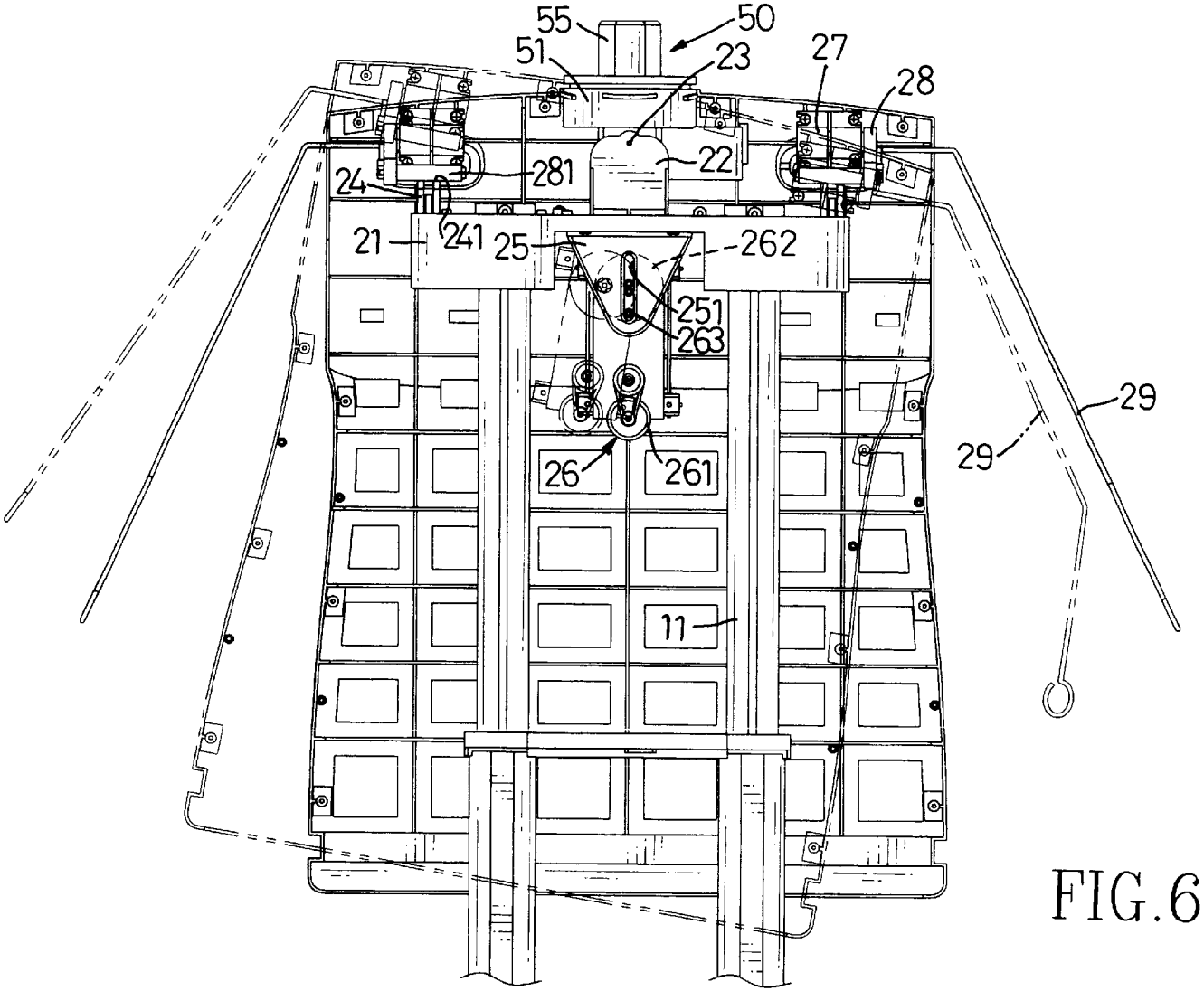
FIGS. 6 and 7 are schematic views of the movable mechanical doll performing actions of moving its shoulders and arms.
Figure 7:
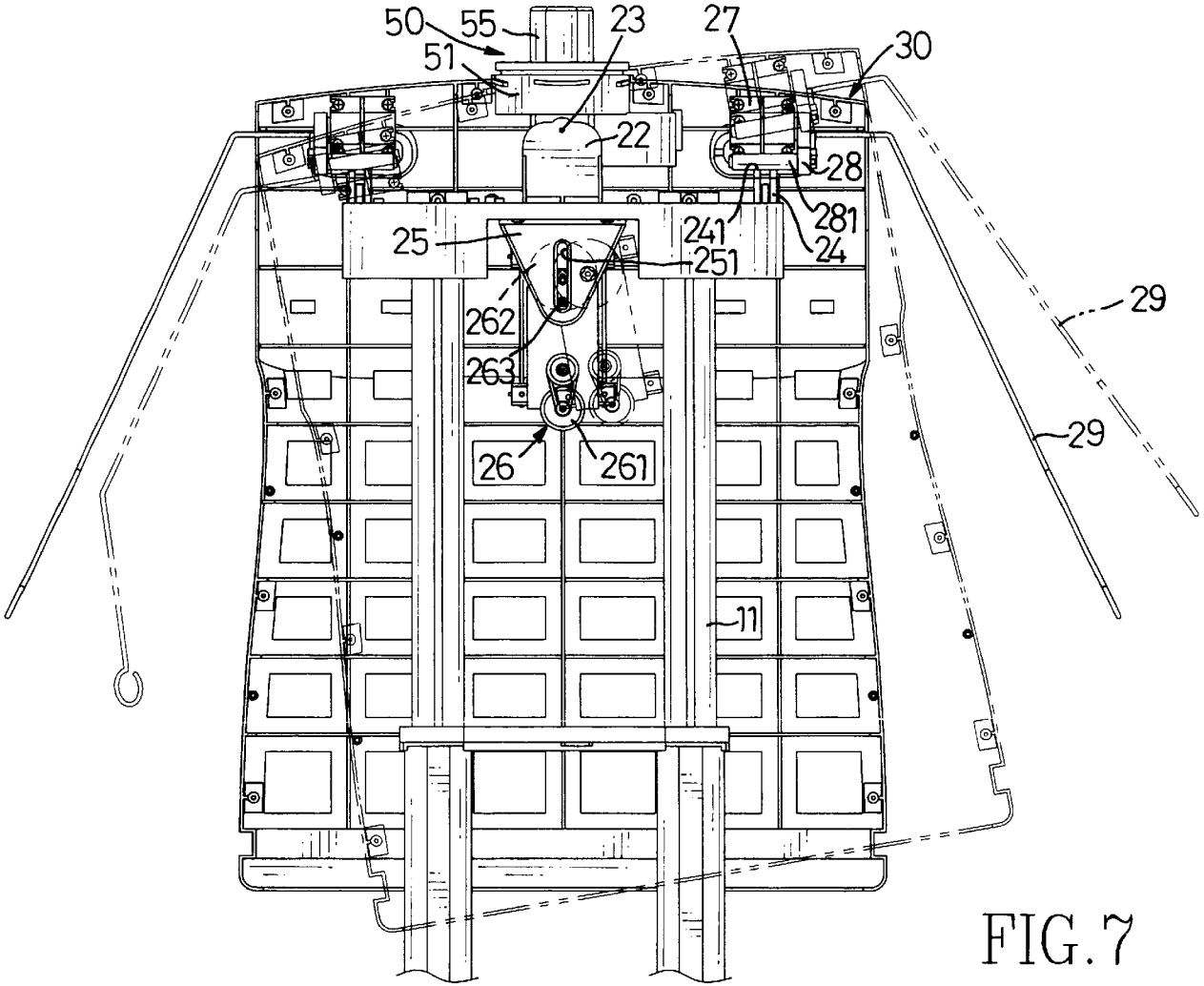

Referring to FIGS. 2–4, the shoulder-arm part (20) has a seat (21) mounted on the legs (11). Two pivoting ears (22) are formed at a center of the seat (21) and parallel to each other. The front and rear semi-housing (31, 32) are pivotally mounted on the pivoting ears (22) by a pivot pin (23) inserted through the pivoting ears (22). The front semi-housing (31) and rear semi-housing (32) are pivotally mounted to the pivoting ears (22) by the pivot pin (23) extending through the housing (30). Two blocks (24), each with an inclined upper surface (241), are formed at two sides of the seat (21). A guide plate (25) is mounted at a rear side of the seat (21) and has an elongated slot (251) longitudinally defined through the guide plate (25). A driving assembly (26) is mounted on the rear semi-housing (32), and has a first motor (261) installed therein and controlled by the circuit board in the bottom seat (10), and a wheel (262) driven by the first motor (261) to rotate. A first lug (263) eccentric to the wheel (262) is formed at a surface of the wheel (262) facing the guide plate (25) and inserted in the elongated slot (251).

Two hinges (27) are mounted on the rear semi-housing (32) and adjacent to the arm openings (34), and each have a hole (271) facing the respective arm opening (34). Two arm joints (28) are pivotally mounted on the hinges (27) respectively, and each have a first shaft (281) abutting the respective inclined upper surfaces (241) and supported by the respective blocks (24), and a second shaft (282) inserted in the hole (271). An aperture (284) is defined at an outer side of the arm joint (28) and substantially aligned with the first shaft (281). A clamping member (283) is formed at the outside of the arm joint (28) and adjacent to the second shaft (282). The arms (29), each with an upper end (not numbered) inserted through the respective aperture (284), are respectively clamped by the clamping members (283) to mount at the outer sides of the arm joints (28).

A speaker (35) is mounted inside the front semi-housing (31) and controlled by the circuit board in the bottom seat (10) to sound.

The neck part (50) extending from the neck opening (33) has a gear seat (51) mounted on the housing (30). A second motor (52) is installed beside the gear seat (51) to drive a gear assembly (not shown or numbered) provided in the gear seat (51). A central tube (511) is formed at a bottom of the gear seat (51) and pivotally mounted between the pivoting ears (22) by the pivot pin (23) extending through the central tube (511). A first disk (53) with a central opening (531) is received in the gear seat (51). An axle (521) of the gear assembly extends through and engaged with the central opening (531) to drive the first disk (53) to rotate. Two second lugs (532) are formed at a top surface of the first disk (53). A second disk (54) is provided above the first disk (53), and has two arcuate slots (541) defined therethrough for the second lugs (532) respectively extending through the arcuate slots (541). A neck member (55) is secured on the second disk (54), and the head (40) is secured on the neck member (55). Referring to FIGS. 4–7, When the first motor (262) is actuated to rotate the wheel (262), the first lug (263) is limited to move along the elongated slot (251), so that the driving assembly (26) and the housing (30) are swung about the pivot pin (23) to achieve an action of moving shoulders. At the same time, the hinges (27) are moved upwards or downwards. Under the gravities of the arm joints (28) and the arms (29), the arm joints (28) can be pivoted about the respective second shafts (2,82) in the hinges (27) and guided by the respective inclined upper surfaces (241). The arms (29) fastened on the arm joints (28) can be swung forwards and rearwards about the hinges (27) respectively to achieve an action of moving arms.

When the second motor (52) is controlled by the circuit board in the bottom seat (10) to actuated, the gear assembly along with the first disk (53) is driven to alternatively rotate clockwise and counter-clockwise. By the second lugs (532) extending through the arcuate slots (541), the second disk (54) and the neck member (55) are driven to rotate the head (40).

According to the present invention, the movable mechanical doll has a simple structure with a small quantity of elements, so that it is easy to assemble the movable mechanical doll with a low manufacturing cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A movable mechanical doll comprising:

a bottom seat (10) having a circuit board installed therein, and two legs (11) upright formed thereon;

a shoulder-arm part (20) mounted at tops of the legs (11), said shoulder-arm part (20) having a seat (21) mounted on said legs (11), two pivoting ears (22) formed at a center of said seat (21) and parallel to each other, a pivot pin (23) inserted through said pivoting ears (22), two blocks (24) each with an inclined upper surface (241) formed at two sides of said seat (21), a guide plate (25) mounted at a rear side of said seat (21) and having an elongated slot (251) longitudinally defined through said guide plate (25); and a housing (30) covering said shoulder-arm part (20) and pivotally mounted to said pivoting ears (22) by said pivot pin (23) extending through said housing (30), said housing (30) having two arm openings (34) respectively defined at two sides thereof, a driving assembly (26) mounted in said housing (30) and at the rear side of the seat (21), said driving assembly (26) having a first motor (261) controlled by said circuit board in said bottom seat (10), a wheel (262) driven by said first motor (261), and a first lug (263) eccentric to the wheel (262) formed at a surface of the wheel (262) facing the guide plate (25) and inserted in the elongated slot (251), two hinges (27) mounted in said housing (30) and adjacent to the arm openings (34), two arm joints (28) pivotally mounted on the hinges (27) respectively, each arm joint (28) having a first shaft (281) abutting the respective inclined upper surfaces (241) and supported by the respective block (24), and two arms (29) respectively installed at outer sides of said arm joints (28) and extending from said arm openings (34).

2. The movable mechanical doll as claimed in claim 1, wherein each of said hinge (27) has a hole (271) facing the respective arm opening (34), and each of said arm joints (28) has a second shaft (282) inserted in said hole (271).

3. The movable mechanical doll as claimed in claim 1, wherein each of said arm joints (28) has an aperture (284) defined at the outer side thereof, and a clamping member (283) formed at the outer side thereof; said arms (29) are respectively clamped by the clamping members (283), and each have an upper end inserted in the respective aperture (284).

4. The movable mechanical doll as claimed in claim 1, wherein said housing (30) is composed of a first semi-housing (31) and a second semi-housing (32).

5. The movable mechanical doll as claimed in claim 1, wherein said housing (30) has a speaker (35) installed therein and controlled by said circuit board in said bottom seat (10).

6. The movable mechanical doll as claimed in claim 1, wherein said housing (30) has a neck opening (33) defined at a top thereof; a neck part (50) extending from said neck opening (33) has a gear seat (51) mounted on said housing (30), said gear seat (51) having a central tube (511) formed at a bottom of said gear seat (51) and pivotally mounted between said pivoting ears (22) by said pivot pin (23) extending through the central tube (511), a second motor (52) installed beside said gear seat (51) and controlled by said circuit board in said bottom seat (10) to drive a gear assembly provided in said gear seat (51), a first disk (53) with a central opening (531) received in said gear seat (51), an axle (521) of said gear assembly extending through and engaged with said central opening (531) to drive said first disk (53) to rotate, two second lugs (532) formed at a top surface of said first disk (53), a second disk (54) provided above said first disk (53) and having two arcuate slots (541) defined therethrough for said second lugs (532) respectively extending through said arcuate slots (541), a neck member (55) secured on said second disk (54); and a head (40) is secured on said neck member (55).

* * * * *